US005755215A

United States Patent [19]

Mickens et al.

[11] Patent Number: 5,755,215

[45] Date of Patent: May 26, 1998

[54] GAS FIREPLACE

[75] Inventors: Robert R. Mickens, Union City, Tenn.; J. Timothy French, Yorba Linda; Samir E. Barudi, Huntington Beach, both of Calif.

[73] Assignee: Superior Fireplace Company, Fullerton, Calif.

[21] Appl. No.: 724,422

[22] Filed: Oct. 1, 1996

[51] Int. Cl.[6] ..... F23M 7/00

[52] U.S. Cl. ..... 126/547; 126/200

[58] Field of Search ..... 126/512, 547, 126/548, 86, 89, 200

[56] References Cited

U.S. PATENT DOCUMENTS 4,683,868 8/1987 Ferguson et al. ..... 126/547

5,001,993 3/1991 Gramlow ..... 126/200

5,655,514 8/1997 Kowald et al. ..... 126/531

*Primary Examiner*—Carroll B. Dority

*Attorney, Agent, or Firm*—Christie, Parker & Hale, LLP

[57] ABSTRACT

A closed-combustion gas fireplace having a glass panel and a means for reducing the temperature of the upper end of the glass panel is disclosed. The temperature reducing means comprises a downwardly depending baffle spaced apart from the upper end of the glass panel to form a channel within the combustion chamber adjacent the upper end of the glass panel. The channel reduces movement of hot gases adjacent the upper end of the glass panel thereby reducing the glass temperatures at that location.

9 Claims, 1 Drawing Sheet

GAS FIREPLACE

FIELD OF THE INVENTION

This invention relates generally to gas fireplaces having a glass door or a window and more specifically to a means for reducing the temperature and the upper end of a glass door or window assembly in a gas fireplace.

BACKGROUND OF THE INVENTION

Fireplaces having one or more glass doors or windows are well known. The glass allows a clearer view of the fire within the fireplace than a wire mesh screen or curtain, while providing the same or better protection against errant sparks from the fire. In sealed combustion chamber gas fireplaces, glass doors or windows also eliminate or at least minimize the consumption of oxygen from the room in which the fireplace is situated and eliminate or minimize venting of exhaust gases, such as carbon monoxide into the room.

While aesthetically pleasing, there are drawbacks associated with the use of glass doors and windows in fireplaces. Soot, i.e., unburned carbon in the combustion gases, may deposit on the glass doors or windows reducing transparency and aesthetic appeal. Further, it is often desirable to have a high temperature within the combustion chamber to maximize transfer of heat to room air circulating around the combustion chamber and in front of the glass door or window. This, however, results in the glass panel achieving a very high temperature, often in excess of 400° C. Such temperatures require the use of tempered glass. Even so, frequent cracking of the glass occurs, typically starting at the top edge of the glass panel where the temperature is at its highest.

SUMMARY OF THE INVENTION

The present invention provides a means for reducing the temperature of a glass panel at its upper end when the assembly is mounted in a fireplace. A preferred temperature reducing means comprises a means for reducing air flows into the area adjacent the upper end of the glass panel. In a preferred embodiment of the invention, the air flow reducing means comprises a baffle assembly including a downwardly depending baffle spaced apart from the upper end of the glass panel, preferably at a distance of from about 1 to about 5 inches.

The invention further provides gas fireplaces incorporating a means for reducing the temperature of the upper end of a glass panel mounted in the fireplace. A preferred gas fireplace comprises a combustion chamber defined at its front side by a wall having a glass panel. Means for introducing combustion air into and means for exhausting hot exhaust gases from the combustion chamber are provided. Means are also provided for reducing the flow of hot exhaust gases adjacent an upper portion of the glass panel. Preferred means for reducing the flow of hot exhaust gases adjacent the glass panel comprises a downwardly depending baffle spaced apart from the upper portion of the glass panel forming a channel between the glass panel and the baffle which reduces the flow of hot gases.

BRIEF DESCRIPTION OF THE DRAWINGS

These and other features and advantages of the present invention will be better understood by reference to the following detailed description when considered in conjunction with the accompanying drawings, wherein.

DETAILED DESCRIPTION

Figure 1:
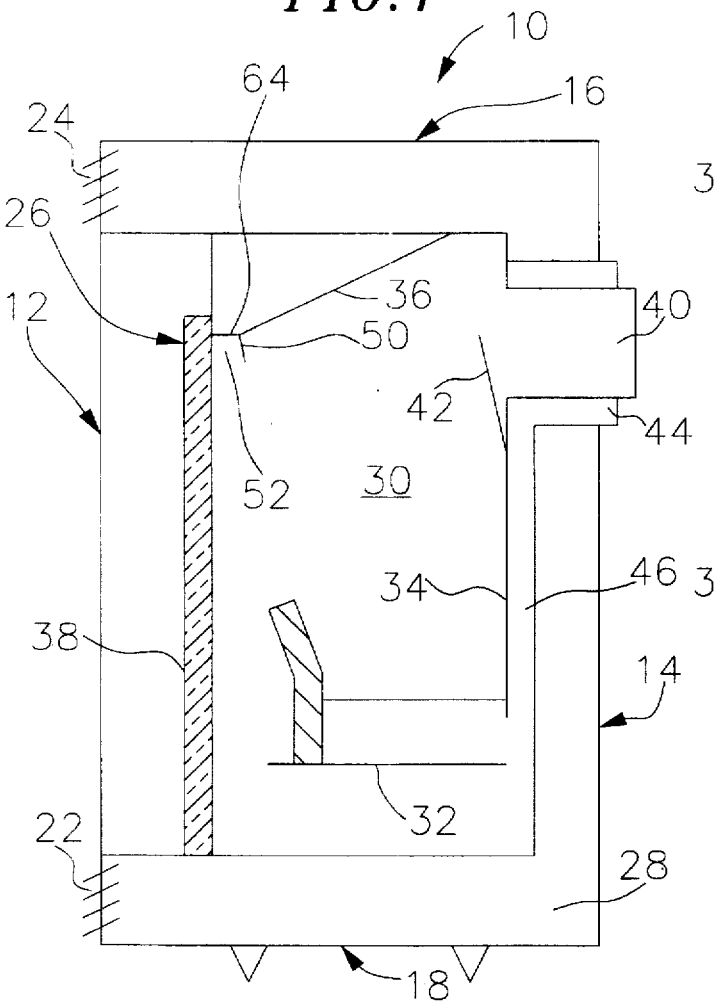
FIG. 1 is a side cross-sectional view of a gas fireplace constructed in accordance with the present invention.

A presently preferred sealed fireplace constructed in accordance with the present invention as shown in FIG. 1. The fireplace 10 is a combustion chamber, rear direct vent gas fireplace. It is generally box-shaped comprising a front wall 12, rear wall 14, top wall 16, bottom wall 18 and two side walls. The front wall comprises an air inlet grill 22 and an air outlet grill 24 and a glass panel assembly 26. The air inlet grill 22 and air outlet grill 24 cover intake and exhaust openings to a series of interconnected room air plenums 28 which surround a combustion chamber 30. Room air is heated as it enters and circulates through the room air plenums 28.

The combustion chamber 30 is bounded by a bottom panel 32, two side panels, a rear panel 34, a top panel 36 and a front glass panel 38. Within the combustion chamber 30 there is provided an angled baffle 42 extending upwardly and forwardly from the rear panel 34. The angled baffle 42 enhances circulation of the hot combustion gases within the combustion chamber 30 which enhances transfer of heat through the top, bottom, sides and rear panels to the room air circulating in the room air plenums 28 and through the glass panel 38 directly to the air in the room. It also blocks the view of exhaust vent 40.

Fresh air is delivered to the combustion chamber 30 through a fresh air vent 44 and fresh air plenum 46 located behind the combustion chamber 30. Exhaust gases pass out of the combustion chamber through the exhaust vent 40.

The fireplace shown can be installed against an exterior wall of a room, the fresh air and exhaust vents 44 and 40 extending through the wall to the outside atmosphere.

A small baffle 50 depends downwardly from the top wall at a location spaced apart from the top edge of the glass panel 38. In the embodiment shown, the baffle 50 extends downwardly and rearwardly. The vertical height of the baffle 50 is preferably from about 42 to about 5 and the distance between the glass panel 38 and the lower edge of the baffle 50 is preferably from about 1 to about 3 inches.

The presence of the baffle 50 reduces movement of hot combustion gases within the space 52 between the baffle 50 and the glass panel 38. By reducing the movement of hot gases in the space 52 adjacent the upper edge of the glass panel 38, the temperature at the upper edge of the glass panel 38 is reduced. For example, with the arrangement shown in FIG. 1, it has been found that, during operation, the temperature of the glass panel 38 at the center of the glass window can be as much as the temperature of the glass adjacent the space 52.

The height, orientation, shape and distance of the baffle 50 from the glass panel 38 are a matter of choice and will depend on a variety of factors. Greater cooling of the upper portion of the glass window will be achieved with a baffle of greater vertical height. That is, the greater the vertical height of the baffle 50, the greater the cooling at the top portion of the glass panel 38. For aesthetic purposes, however, baffles having a lesser vertical height are preferred.

Figure 2:
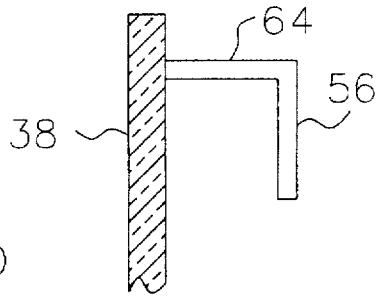
FIG. 2 is an enlarged side cross-sectional view of an alternate baffle arrangement.
Figure 3:
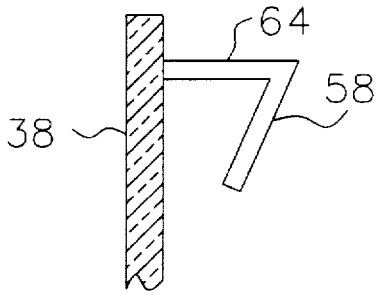
FIG. 3 is an enlarged side cross-sectional view of another alternate baffle arrangement.

The baffle 50 may be oriented at a downward and rearward angle as shown in FIG. 1. Alternatively, glass panel assemblies may be provided having baffles of other orientations. For example, a vertical baffle 56 may be used as shown in FIG. 2. Another alternative is shown in FIG. 3, wherein the baffle 58 has a downward and forward angle. For efficiency in reducing the movement of air adjacent the glass panel, the baffle orientation of FIG. 3 is preferred. However, in the arrangement shown in FIG. 3, the baffle is more noticeable than the arrangement of FIG. 1. Hence, for aesthetic appeal, the orientation of FIG. 1 is presently preferred.

Figure 4:
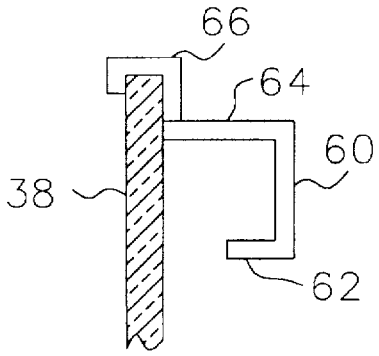
FIG. 4 is an enlarged side cross-sectional view of another alternate baffle arrangement.

The cross-sectional shape of the baffle is also a matter of choice, the cross-sectional shapes of the baffle as shown in FIGS. 1–3 are generally straight. It is understood that other shapes may be used. For example, in FIG. 4, the baffle 60 has a generally L-shaped cross-section. The bottom, i.e., horizontal, leg 62 of the baffle extends forwardly and is effective in further reducing the movement of air in the space between the baffle 60 and the glass panel 38.

In the glass panel assemblies shown in FIGS. 1–4, the baffle is supported by a generally horizontal baffle support 64. The baffle support 64 may be part of the top panel of the fireplace or may be a separate structure. If separate, any suitable means for attaching the baffle support to the glass panel 38, such as glass receiving channel 66, may be used. It is understood that the baffle, baffle support and glass receiving panel channel, if present, may be an integral, one-piece construction, or may be separate components connected to each other by suitable means, e.g., welding, rivets, screws, etc.

The preceding description is presented with reference to a presently preferred embodiment of the invention shown in the drawings. Workers skilled in the art and technology to which this invention pertains will appreciate that alterations and changes in the described structures can be practiced without meaningfully departing from the principle, spirit, and scope of this invention.

Accordingly, the foregoing description should not be read as pertaining only to the precise structures described and shown in the accompanying drawings, but rather should be read as consistent with and as supporting the following claims, which are to have their fullest and fair scope.

What is claimed is:

1. A closed combustion chamber gas fireplace comprising:

a combustion chamber bounded by a plurality of walls, at least one wall comprising a glass panel;

means for introducing air for combustion into the combustion chamber;

means for exhausting hot exhaust gases from the combustion chamber; and a baffle depending from a top wall of the combustion chamber and spaced apart from an upper portion of the glass panel, wherein the baffle has a lowest portion for traping and reducing the movement of hot gases between the baffle lowest portion, the upper wall, and the upper portion of the glass panel.

2. A closed combustion chamber gas fireplace as claimed in claim 1 wherein the lower edge of the baffle is at a distance of from about 1 to about 5 inches from the glass panel.

3. A closed combustion chamber fireplace as claimed in claim 2 wherein the baffle has a generally vertical height of from about 42 to about 5 inches.

4. A closed combustion chamber fireplace as claimed in claim 1 wherein the baffle depends downwardly and rearwardly from the top wall.

5. A closed combustion chamber fireplace as claimed in claim 1 wherein the baffle depends downwardly and forwardly from the top wall.

6. A closed combustion chamber fireplace as claimed in claim 1 wherein the baffle depends vertically from the top wall.

7. A closed combustion chamber fireplace as claimed in claim 1 wherein the baffle is generally L-shaped.

8. A closed combustion chamber gas fireplace comprising:

a combustion chamber producing hot gases, the combustion chamber bounded by a plurality of walls, at least one wall comprising a glass panel; and a baffle extending rearwardly and downward from an upper portion of the glass panel whereby the baffle traps and reduces the movement of hot gases adjacent an upper portion of the glass panel.

9. A closed combustion chamber as recited in claim 8 wherein a lower portion of the baffle further extends inwardly toward said glass panel.

* * * * *